US007261526B1

(12) United States Patent
Del Rio

(10) Patent No.: US 7,261,526 B1
(45) Date of Patent: Aug. 28, 2007

(54) CYLINDER FOR A VANE MOTOR

(75) Inventor: Eddy H. Del Rio, Royal Palm Beach, FL (US)

(73) Assignee: The Anspach Effort, Inc., Palm Beach Gardens, FL (US)

( * ) Notice: Subject to any disclaimer, the term of this patent is extended or adjusted under 35 U.S.C. 154(b) by 15 days.

(21) Appl. No.: 11/099,897

(22) Filed: Apr. 6, 2005

Related U.S. Application Data

(60) Provisional application No. 60/567,188, filed on Apr. 30, 2004, provisional application No. 60/567,189, filed on Apr. 30, 2004.

(51) Int. Cl.
*F03C 2/00* (2006.01)
*F04C 2/00* (2006.01)

(52) U.S. Cl. ..... 418/15; 418/82; 418/180; 418/259

(58) Field of Classification Search ..... 418/266–270, 418/180, 82, 259, 15
See application file for complete search history.

(56) References Cited

U.S. PATENT DOCUMENTS 3,453,936 A * 7/1969 Biek et al. ..... 418/82
3,734,652 A * 5/1973 Barnett ..... 418/70
3,827,834 A * 8/1974 Kakimoto ..... 418/270
6,241,500 B1 * 6/2001 Ellis ..... 418/270

FOREIGN PATENT DOCUMENTS

JP 56056979 A * 5/1981 ..... 418/270
JP 06066101 A * 3/1994 ..... 418/270

* cited by examiner

*Primary Examiner*—Theresa Trieu
(74) *Attorney, Agent, or Firm*—Norman Friedland

(57) ABSTRACT

A cylinder to a vane motor is designed to include cylindrically shaped inlet and outlet holes, an axial passage that includes a blocked upstream portion that bypasses the upstream inlet holes, spaced circumferentially slots for leading a portion of the pressurized air into the inlet holes, discharging the portion of pressurized air from the axial passage into an annular cavity to bathe the bearing in the cooler pressurized air, and recirculating the portion of pressurized air through another axial passageway to flow into all of the inlet holes. The discharge holes are judiciously oriented in a particular pattern to assure that the edge of the vanes wear uniformly. The inlet holes are spaced from the pinch point of the spindle to cylinder to permit an increased volume of pressurized air to enter the vane motor and the outlet holes are spaced to maximize the power stroke of the vane motor. The pressurized air is introduced centrally in the motor housing and diverted to flow to the outer periphery of the cylinder.

11 Claims, 3 Drawing Sheets

CYLINDER FOR A VANE MOTOR

This application claims the benefits under 35 U.S.C. § 119(e) of the U.S. provisional patent application 60/567,188 and 60/567,189 filed on Apr. 30, 2004

RELATED APPLICATIONS

This invention relates to the pneumatic motor entitled SURGICAL PNEUMATIC MOTOR and was invented by myself and co-inventor Douglas Perry and identified as Ser. No. 11/082,124 and SURGICAL PNEUMATIC MOTOR FOR USE WITH MRI invented by myself and identified as Ser. No. 11/074,821 both of which were recently filed as non-provisional applications and are incorporated herein by reference and are commonly assigned with this application to The Anspach Effort, Inc.

FEDERALLY SPONSORED RESEARCH OR DEVELOPMENT

Not applicable

TECHNICAL FIELD

This invention relates to the cylinder of a pneumatic vane motor of the type that converts fluid pressure to rotational movement and particularly to the design of the cylinder that results in an increase in efficiency, RPM and torque and reduce vibration and noise of the vane motor. The innovative cylinder also serves to increase the life of the vane and cool the vane motor and consequently, the size, temperature and life of the vane motor and the rotary machine incorporating the vane motor.

BACKGROUND OF THE INVENTION

Rotary machines typically utilize vane motors that are pneumatically powered to cause rotation of the output shaft. As is well known these machines comprise a cylinder, sometimes referred to as a casing and an eccentrically mounted spindle relative to the bore of the cylinder, sometimes referred to as a rotor. The cylinder is stationary and through apertures in the cylinder lead pressurized air to impinge on the working face of the reciprocating vanes mounted in slots formed in the spindle to cause the spindle to rotate and then exhaust the spent air through additional holes formed in the cylinder. The outer edge of the vanes is in contact with or in close proximity to the inner surface of the cylinder and the spindle during the power stroke of the vane motor transitions from close to the inner surface of the cylinder bore toward the furthest distance there from and during the exhaust portion of the stroke the spindle transitions from the furthest point away the inner surface of the cylinder toward the closest point thereto. Heretofore, the cylinder had apertures formed therein that were configured in the shape of slots. The pressurized air that is admitted to the spindle impinge on the working face of the vanes to cause them to rotate the spindle.

I have found that the vane motor can be enhanced by substituting cylindrical holes for the slots, providing a series of axially spaced holes defining the inlet to the vane motor, providing a pressurized air axial passageway in the cylinder to feed pressurized air to these inlet holes, by-passing the upstream portion of the inlet holes and providing circumferential slots in the cylinder that feed a portion of the pressurized air to the inlet holes, discharging that portion of the pressurized air to circulate over the bearings supporting the spindle and providing another axial passageway for returning the remaining pressurized air to the inlet holes and providing a plurality of judiciously located discharge cylindrical holes to discharge the spent air after performing work on the vanes. The routing of the pressurized air and spent air flowing into and out of the cylinder is done in such a way as to reduce both heat and noise that would otherwise be generated by the vane motor. Suffice it to say that this invention affords the following features that serve to enhance the vane motor and in certain medical instruments, such as a surgical drill, this invention reduces heat, vibration, noise and allows for a smaller envelope size that goes to the comfort and feel in the hands of a surgeon.

1. Smaller motor spherical ball bearing located at the fore end of the power cylinder provides a cavity within the housing to re-circulate the power cylinder's working compressed air which contributes to lowering the temperature of the bearing and affording improvements to the vibrations and heat characteristics.
2. Cylinder input holes are oriented relative to the spindle vanes so as to increase input airflow acting on the vane's working surface.
3. Slots in the cylinder formed adjacent to the inlet holes cool the cylinder before entering the vane motor.
4. A portion of the inlet air to the motor is diverted to flow to the front bearing and toward the aft end so as to air cool the front bearing housing and air cool the cylinder.
5. Additional increased power is obtained by the orientation of the exhaust holes in the vane motor relative to the inlet holes.
6. Minimizing vane wear by the uniform distribution of the vane's contact area with the cylinder.

SUMMARY OF THE INVENTION

An object of this invention is to provide for a vane motor an improved cylinder.

A feature of this invention is to provide cylindrical holes for the inlet and exit holes of the cylinder.

Another feature of this invention is to provide inlet air passages leading pressurized air to the outer periphery of the cylinder through an axial slot, allowing a portion the air to by-pass the inlet holes, a portion to flow through circumferential grooves formed in the cylinder to feed the inlet holes and to flow past the cylinder over the bearings and back into the cylinder and then through the inlet holes so as to power the spindle.

Another feature of this invention is to judiciously space the outlet holes of the cylinder so that the vanes uniformly contact the surface of the cylinder as it traverses each station of the cylinder to enhance the wear of the vane.

Another feature of this invention is to position the inlet of the vane motor relative to the vane to maximize the volume of air being admitted to the vane during the power stroke.

Another feature of this invention is to locate the inlet relative to the outlet of the vane motor to maximize the power stroke of the vane motor.

Another feature of this invention is to include cris cross discharge passages in the outlet circuit of the vane motor's spent air.

This invention provides a cylinder for a vane motor that is characterized as reducing heat, cooling the bearings, reducing vibrations and noise, being more efficient so as to increase the RPM and torque of the motor while at the same time reducing its size and extending its life.

The foregoing and other features of the present invention will become more apparent from the following description and accompanying drawings.

These figures merely serve to further clarify and illustrate the present invention and are not intended to limit the scope thereof.

DETAILED DESCRIPTION OF THE INVENTION

While this invention is being described in its preferred embodiment as the cylinders that are in the vane motors utilized in surgical pneumatic drills, as one skilled in the art will appreciate this improved cylinder and its appurtenances can be utilized for any type of pneumatic motor that is employed in any type of pneumatic surgical drill as well as any other pneumatic rotary machines that may or may not be utilized in the medical industry.

Figure 1:
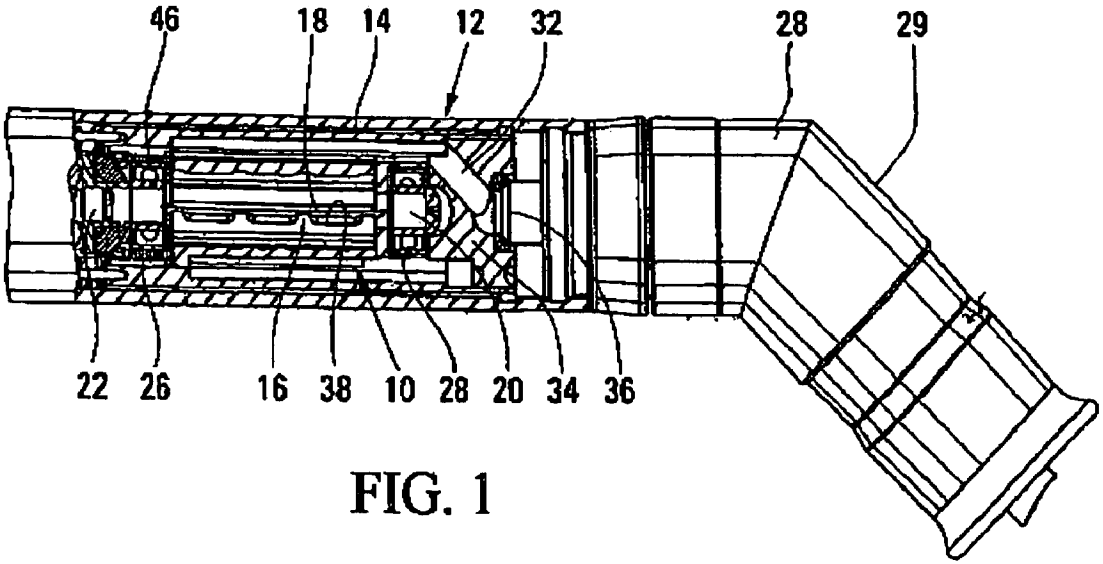
FIG. 1 is a partial view partly in section and partly in elevation illustrating the cylinder and its associated parts of a vane motor enclosed in a rotary machine.

Referring next to all the Figs. the vane motor generally illustrated as reference numeral 10 is encased in a housing generally illustrated by reference numeral 12 and includes the cylinder 14 affixed to housing 12 in any suitable manner and the rotary spindle 16 and its vanes 18 supported in cylinder 14. As is typical in vane motors the spindle includes stub shafts 20 and 22 suitably supported by bearings 24 and 26, respectively, which in this instance are ball bearings. The partial view of the surgical drill depicted in FIG. 1 includes a swivel connection 28 and suitable fittings to connect to a hose 29 for providing pressurized air to power the vane motor. The details of these components are well known and for the sake of simplicity and convenience are omitted here from. However, in accordance with this invention, the pressurized air used to power the vane motor is admitted into the central portion of the housing 12 and then to the outer periphery of the cylinder 14 of the vane motor via the inlet port 30 and the passage 32, respectively and will be described in detail herein below.

In this rotary machine 12 and as mentioned above, the inlet air is admitted into a central opening or inlet port 30 formed in the end cap 34 which is located at the rear end of the motor housing 12 and is then directed toward the outer periphery via the passageway 32 also formed in the end cap 34. Passageway 32 is in communication the axial groove 36 formed in the outer surface of cylinder 14 that serves to feed the inlet axially spaced cylindrical holes 38. A portion of the pressurized air flows past the cylinder and then over the bearing 26 and then back into the cylinder 14. Along the travel of the air toward the fore end a certain portion of the air is admitted into the vane motor while a portion serves to cool the cylinder 14 and the bearing 26 as described above and this air is then returned to the cylinder via the axial passage 40 where it then flows into the vane motor via the inlet axially spaced cylindrical holes 38.

Figure 2:
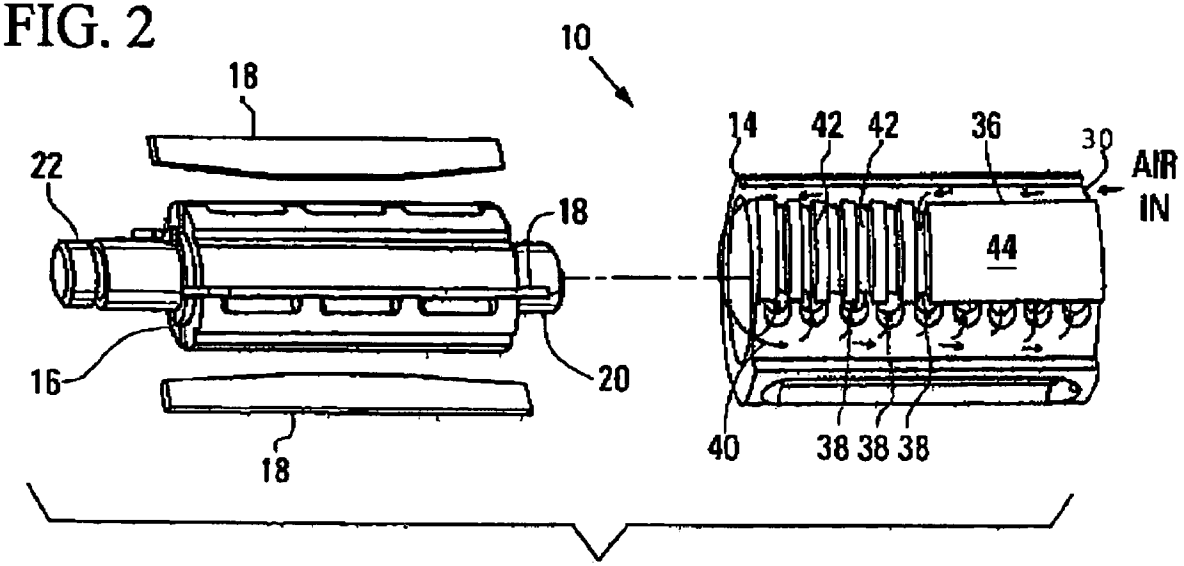
FIG. 2 is an enlarged exploded view in perspective of the vane motor of this invention.
Figure 3:
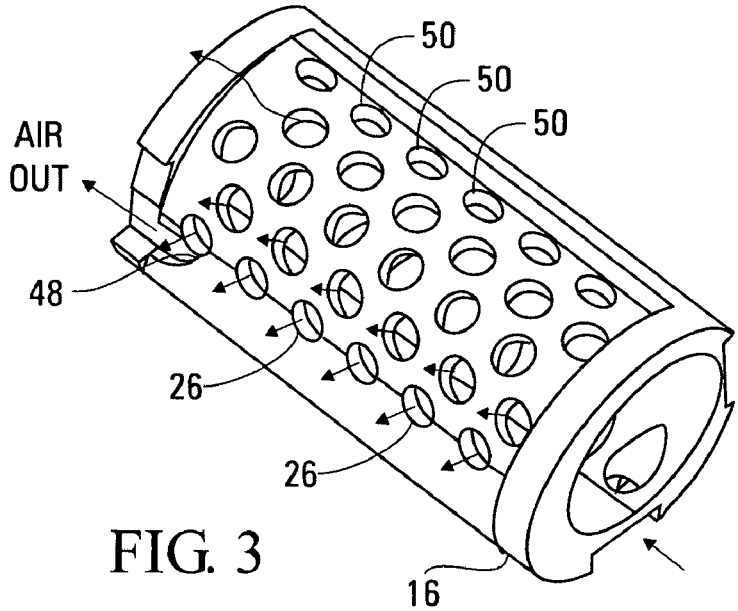
FIG. 3 is an enlarged perspective view of one side of the cylinder opposite the side depicted in FIG. 2 and illustrating the exhaust holes and passageway.

In accordance with one aspect of this invention, the pressurized air not only serves to cool the bearing it also serves to cool the cylinder. This is best illustrated in FIGS. 2 and 3 illustrating that the pressurized air being admitted into the cylinder 14 flows via axial passageway 36 toward the forward end of the housing 12. A portion of this air flows into inlet cylindrical holes 38 via the axially spaced slots 42 formed in cylinder 14. As noted the slots 42 are located downstream of the blockage portion 44 formed on the outer diameter of cylinder 14 which serve to by-pass the inlet axially spaced cylindrical holes 38 located adjacent thereto. The purpose of the blocking portion 44 and the slots 42 is to dissipate the heat from the cylinder so as to cool the cylinder and the high speed spindle and vanes. The remaining portion of the pressurized air discharges from axial passageway 36 exiting cylinder 14 and flows over the bearing 26 and hence, cools the bearing 26. This air that flows around the bearing 26 flows via the annular cavity 46. Thereafter, the air after cooling the bearing is then re-admitted into the cylinder 14 via axial passageway 40 formed on the outer periphery of the cylinder 14. Axial passageway 40 is in communication with the inlet axially spaced cylindrical holes 38 as best shown in FIG. 2. It will be appreciated that because of the innovations to the cylinder resulting in a more efficient vane motor, the ball bearing 26 can be made smaller than the heretofore designs. The reduced diameter of the bearing for a given envelope serves to create or define the annular cavity 46. That portion of the air used for cooling bearing 26 recirculates back to the cylinder via the annular cavity 46 is in communication with the axial passageway 40.

It is apparent from the foregoing that the pressurized air from the source flows toward the forward end of the rotating machine and then reverses to flow toward the rear of the rotating machine. This allows a multiple use of the pressurized air before all of the air is admitted into the vane motor. The first portion of the pressurized air serves to cool the cylinder while a portion enters the inlet holes into the vane motor and the remaining portion of the pressurized air cools the bearing before it is admitted into the vane motor via axial passageway 40 and inlet holes 38. Ultimately, all the pressurized air feeds into the vane motor to impinge on the vanes so as to power the spindle. The spent air exits the vane motor via the axial slot 48 and discharge holes 50 and then discharged from the motor housing 12.

Figure 4:
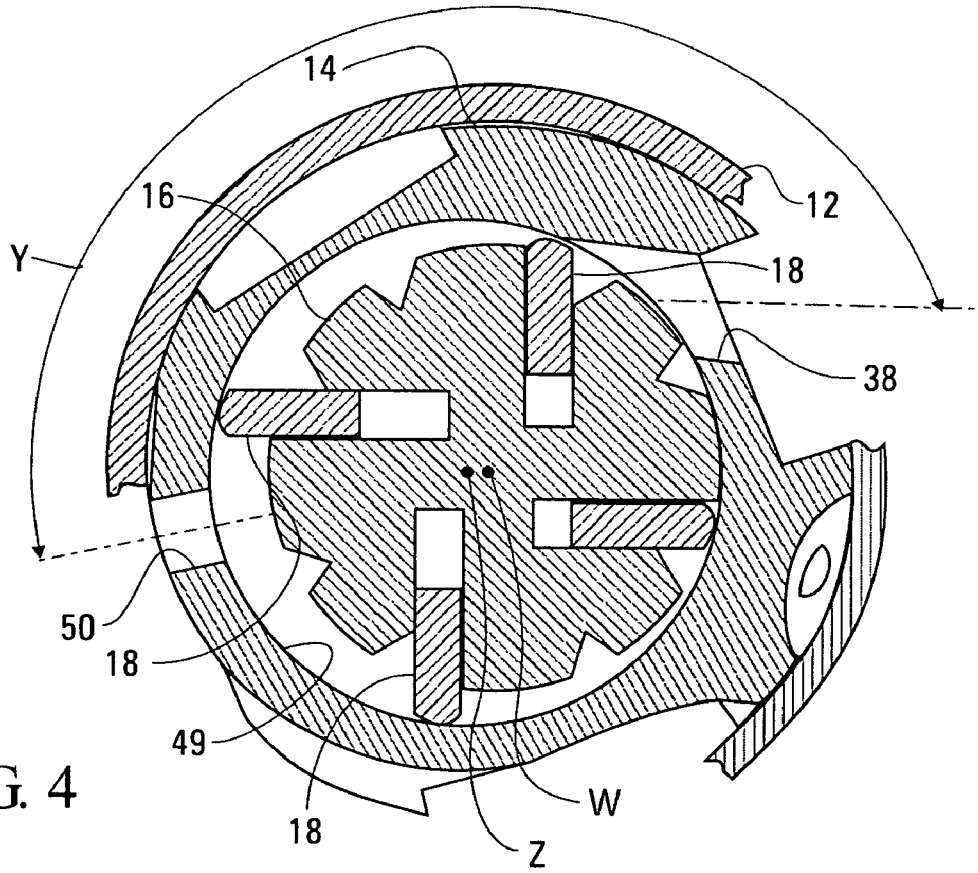
FIG. 4 is a sectional view of the vane motor illustrating the relationship of the inlet to the outlet in accordance with this invention.
Figure 5:
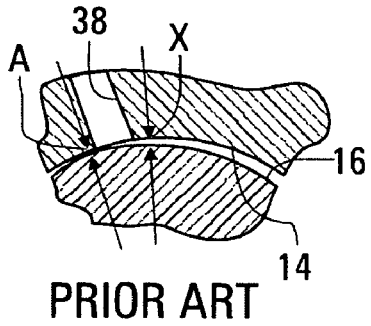
FIG. 5 is a view in section illustrating the relationship of the inlet to the spindle of a prior art vane motor.
Figure 5A:
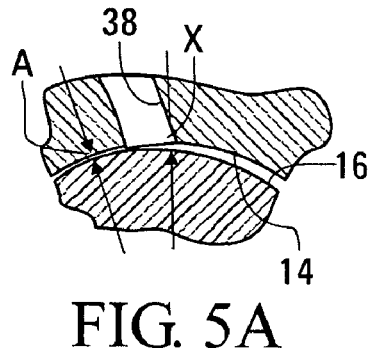
FIG. 5A is a view in section illustrating the relationship of the inlet to the spindle of the present invention.

The next portion of this description will describe the inlet holes 38 which are another aspect of this invention. As mentioned above, the inlet holes 38 are contoured in a cylindrical shape for increasing the power of the vane motor. In addition, as noted from FIGS. 5 and 5A the inlet axially spaced cylindrical holes 38 are discretely located relative to the spindle 16 so as to increase the volume of air being admitted to impinge on the vane 18 during the power stroke. In the heretofore known vane motors the inlet apertures were located adjacent to the pinch point indicated by reference letter A which is the tangent point where the inner surface of the cylinder 14 contacts or nearly so the spindle 16 as best seen in FIG. 5 and this defines the gap X. As seen in FIG. 5A the inlet axially spaced cylindrical hole 38 is positioned away from the pinch point A increasing the gap X and hence, allowing a sufficiently greater amount of air to enter the vane motor during the power stroke with an obvious increase in the vane motor's performance. This feature not only serves to increase the volume of air entering the vane motor but also positions the inlet axially spaced cylindrical hole 38 a further distance away from the outlet 50. As can be seen in FIG. 4, the cylinder spindle 16 rotates about its central axes W and the axis Z of the bore 49 formed in cylinder 14 and hence placing the spindle eccentric to the center of the bore 49 and causing the spindle and vanes to advance in close proximity thereto during the power stroke and away therefrom during the exhaust stroke. By increasing this distance, namely the inlet axially spaced cylindrical hole 38 to the outlet 50 represented by reference letter Y, the power stroke is accordingly increased and hence, the power of the vane motor is enhanced.

In accordance with another aspect of this invention, not only is the circumferential distance between the inlet hole 38 and the exit hole 50 selected for increased power, the orientation of holes 50 are judiciously selected to avoid power losses and increase wear on the vane. Because of the arrangement of pattern these discharge holes in heretofore known surgical vane motors, there exhibited an unevenness of wear on the outer edge of the vanes. This invention addresses the problem of this unevenness and describes a solution to solve this problem as will be discussed herein below.

Figure 6:
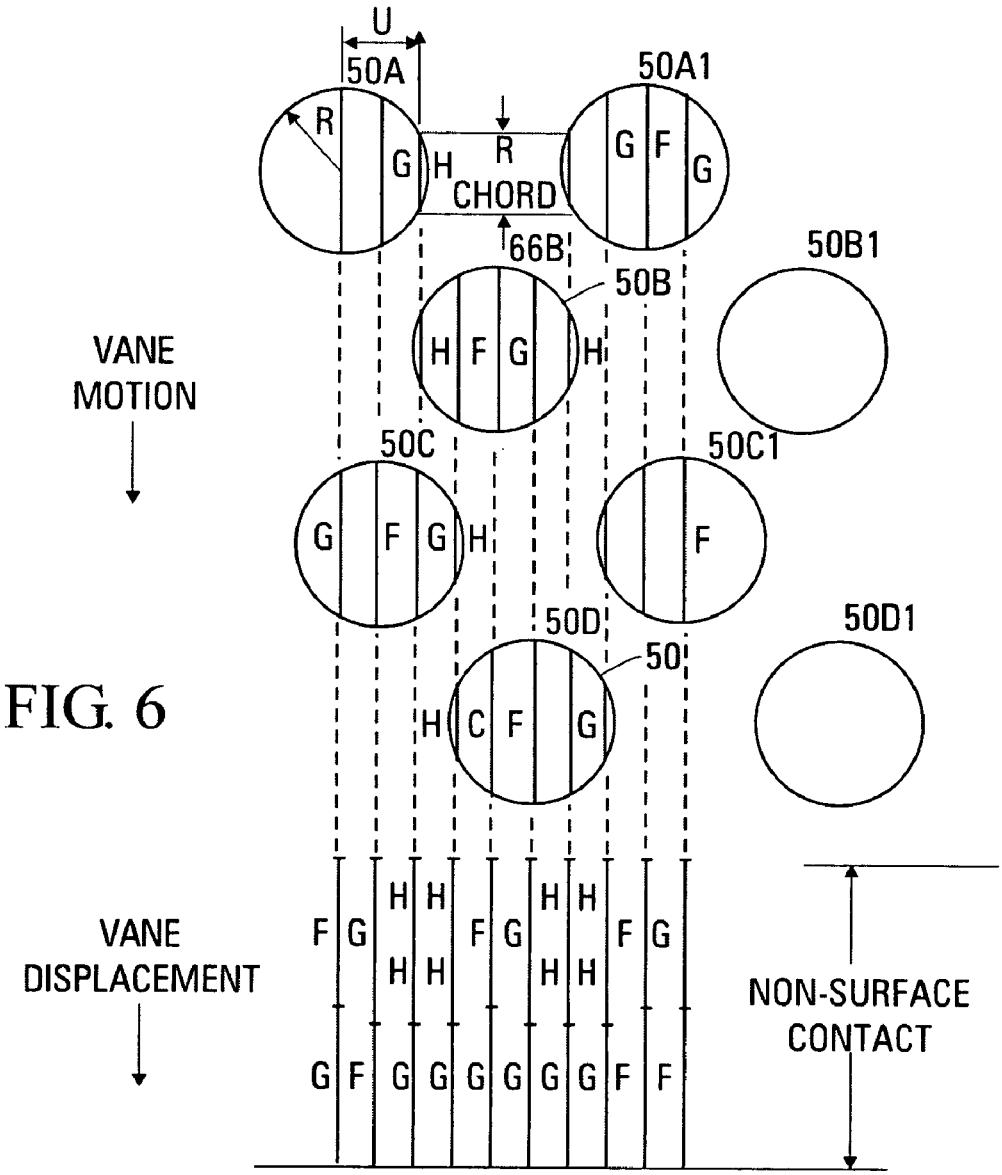
FIG. 6 is a graphical representation illustrating the uniform contact of the vane as it traverses each station of the cylinder and the orientation of the cylinder discharge holes to achieve this result.

Attention is first directed to FIG. 3 which illustrates the discharge holes 50 judiciously disposed in cylinder 16 in a circumferential and axial direction and serve as the exhaust outlet for vane motor. These holes are arranged so that the vane passing thereunder will virtually see an even contact of the cylinder surface so as to eliminate the uneven wearing of the vane's outer edge. As mentioned above, previous vane motors required early replacement of the vanes because the outer edges exhibited an unevenness of wear. It was recognized that this unevenness resulted in the placement of the discharge holes. This invention solved the problem by selecting a pattern of holes that proved to avoid this unevenness. FIG. 6 is a showing of a portion of the inlet hole pattern where the column of holes 50 are identified as 50A, 50A1, 50B, 50B1, 50C, 50C1, 50D and 50D1. For each repeat in the pattern of holes the relative location of holes A and B is such that a unit of measure U is established for one hole and used to position all the other holes. Referring to hole 50A in FIG. 3, the cord H at the right hand side is selected and it equals the radius R. The distance between the center line of hole 50A and this cord H establishes the unit U (the unit of measurement) which is used for the measurement to set the relative distance of all other cords within a column. Each space between cords (vertical lines) equals ½ the unit of measurement U. As is apparent from the foregoing, the holes are aligned in columns and rows, while the spacing of the rows is not critical however the adjacent hole in a given row cannot overlap its adjacent hole. The hole 50B is established by aligning chords H of 50B with chords H of 50A and 50A1. In the next row 50C is established by aligning the chord G with the centerline F of 50A. Row 50C1 is established by aligning centerline F of 50C1 with chord G of 50A1. With this pattern of holes, each of the vanes 18 will displace uniformly over the surface of the cylinder 16.

As is apparent from the foregoing one repeat of the hole pattern is described and it is to be understood that all repeats are identical. In this arrangement of holes, no holes in any row overlap each other. It will be noted that the displacement of the first two chords over the holes 50A and 50C is equal to F and G. The next displacement over the holes 50A and 50C is equal to G and F. The next displacement of vane 18 is over the holes in 50A, 50B and 50C and this is equal to chords H, H and G. By following this pattern throughout the displacement of the vanes it will be noted that the total distance and hence, area that the edge of the vane is in contact with each of the holes of the cylinder is equal. It then follows that the total average area of contact that the edge of the vane makes relative to the surface of the cylinder is also equal. By designing the hole pattern of the cylinder in this manner, the vanes will wear evenly throughout its cycle and hence, will evidence a longer life.

What has been shown by this invention is an improved cylinder for a vane motor that minimizes vane wear that with respect to the discharge holes 50, the contact area made by the vanes is even and the exhaust noise level is reduced; with respect to the input holes 39, the input air flow is increased and the power stroke is expanded; with to the slots 42, the heat transfer from the cylinder to the operating air flow is increased; by diverting the air flow from the cylinder, the front bearing is cooled, all of which contribute to the increase of power, the increase of torque, the reduction of vibrations, noise and heat.

Although this invention has been shown and described with respect to detailed embodiments thereof, it will be appreciated and understood by those skilled in the art that various changes in form and detail thereof may be made without departing from the spirit and scope of the disclosed invention.

It is claimed:

1. In combination, a rotary machine having a housing supporting a vane motor, said vane motor including a cylinder, a spindle rotary supported in said cylinder and vanes reciprocally mounted in said spindle, said cylinder having an axial passageway formed in the outer periphery thereof for receiving pressurized air from an opening formed in said housing, a plurality of axially spaced inlet cylindrical holes radially spaced from said axial passageway, a plurality of axially spaced circumferential grooves formed in the outer portion of said cylinder flowing pressurized air from said axial passageway to certain of said axially spaced inlet cylindrical holes, a bearing supporting said spindle mounted in a cavity downstream of said axial passageway, said axial passageway in fluid communication with said cavity for flowing a portion of said pressurized air thereto to bath said bearing, a second axial passageway in fluid flow relationship with said axially spaced inlet cylindrical holes formed in the outer diameter of said cylinder for leading said portion of pressurized air into said axially spaced inlet cylindrical holes, and a plurality of discharge apertures formed in said cylinder for discharging the spent air from said cylinder and being circumferentially spaced from said axially spaced inlet cylindrical holes.

2. The combination as claimed in claim 1 wherein the discharge apertures are formed in cylindrically shaped holes.

3. The combination as claimed in claim 2 wherein said cylinder includes a central bore and said spindle being eccentrically mounted in said central bore and said central bore defining an inner surface, said spindle rotating in said bore and comes into the closest proximity to said inner surface to define a pinch point, said axially spaced inlet cylindrical holes being spaced a predetermined distance from said pinch point to admit the optimum volume of said pressurized air into said vane motor.

4. The combination as claimed in claim 3 wherein said axially spaced inlet cylindrical holes are spaced a predetermined distance from said discharge cylindrical holes to maximize the pressure stroke of said vane motor.

5. The combination as claimed in claim 4 wherein the plurality of discharge cylindrically shaped holes are oriented in columns and rows and that the discharge cylindrically shaped holes in adjacent rows do not overlap each other and the plurality of discharge cylindrically shaped holes are located in a predetermined pattern to assure even wear of said vanes.

6. A rotary machine having a housing including a central opening for leading pressurized air into said housing, a vane motor disposed in said housing having a cylinder, a spindle rotary supported in said cylinder and vanes reciprocally mounted in said spindle, a fluid line interconnecting said central opening and said cylinder for leading pressurized fluid through said cylinder to impinge on said vanes to cause rotary motion to said spindle, said cylinder having an axial passageway formed in the outer periphery thereof for receiving pressurized air from said fluid line, a plurality of axially spaced inlet cylindrical holes radially spaced from said axial passageway, a plurality of axially spaced circumferential grooves formed in the outer portion of said cylinder flowing pressurized air from said axial passageway to certain of said axially spaced inlet cylindrical holes, a bearing supporting said spindle mounted in a cavity downstream of said axial passageway, said axial passageway in fluid communication with said cavity for flowing a portion of said pressurized air thereto to bath said bearing, a second axial passageway in fluid communication with said axially spaced inlet cylindrical holes formed in the outer diameter of said cylinder for leading said portion of pressurized air into said axially spaced inlet cylindrical holes, and a plurality of discharge cylindrical holes in formed in said cylinder circumferentially spaced from said axially spaced inlet cylindrical holes for discharging the spent air created by the air impinging on said vanes from said cylinder.

7. The combination as claimed in claim 6 wherein said cylinder includes a central bore and said spindle being eccentrically mounted in said central bore and said central bore defining an inner surface, said spindle rotating in said bore and comes into the closest proximity to said said inner surface to define a pinch point, said axially spaced inlet cylindrical holes being spaced a predetermined distance from said pinch point to admit the optimum volume of said pressurized air into said vane motor.

8. The combination as claimed in claim 7 wherein said axially spaced inlet cylindrical holes are spaced a predetermined distance from said discharge cylindrical holes to maximize the pressure stroke of said vane motor.

9. The combination as claimed in claim 8 wherein said plurality of discharge cylindrically shaped holes are oriented in columns and rows and that said discharge cylindrically shaped holes in adjacent rows do not overlap each other and said plurality of discharge cylindrically shaped holes are located in a predetermined pattern to assure even wear of said vanes.

10. A rotary machine having a housing including a central opening for leading pressurized air into said housing, a vane motor disposed in said housing having a cylinder, a spindle rotary supported in said cylinder and vanes reciprocally mounted in said spindle, a fluid line interconnecting said central opening and said cylinder for leading pressurized fluid through inlet cylindrical holes formed in said cylinder to impinge on said vanes to cause rotary motion to said spindle, said cylinder including a plurality of discharge cylindrical holes circumferentially spaced from said inlet cylindrical holes for discharging the spent pressurized air after impinging on said vanes, said spindle being eccentrically mounted in a central bore defined by said cylinder and said central bore defining an inner surface, said spindle rotating said bore defining a point where the spindle comes into the closest proximity to said inner surface, said inlet cylindrical holes being spaced a predetermined distance from said point to admit the optimum volume of said pressurized air into said vane motor, said inlet cylindrical holes being spaced a predetermined distance from said discharge cylindrical holes to maximize the pressure stroke of said vane motor, by locating the discharge cylindrical holes at a distance substantially equal to when the inlet air ahead of the vane being acted on by said inlet air reaches its maximum volume.

11. The combination as claimed in claim 10 wherein the plurality of discharge cylindrical holes are oriented in columns and rows and said discharge cylindrical holes include at least two columns of holes and at least four rows of holes and said rows are in the circumferential direction and that the discharge cylindrical holes in adjacent rows do not completely overlap each other such that the center of the hole in one of the rows does not coincide with the center of the next adjacent hole in the next row and a portion of said hole in the row overlaps a portion of said adjacent hole and the plurality of discharge cylindrical holes are located in a predetermined pattern to assure that the surface of the vanes uniformly are supported by the inner surface of the cylinder during each revolution of said vanes so as to attain even wear of said vanes.

* * * * *